US006464105B1

(12) United States Patent
Rolle et al.

(10) Patent No.: US 6,464,105 B1
(45) Date of Patent: Oct. 15, 2002

(54) DEVICE FOR WITHDRAWING A READY LIQUID MEDICAMENT FROM A RECEPTACLE PROVIDED WITH A PIERCEABLE MEMBRANE

(75) Inventors: Alexander Rolle, Schillsdorf; Ingoberth Schoenke, Henstedt-Ulzburg, both of (DE)

(73) Assignee: Transcoject Gesellschaft für medizinische Geräte mbH & Co. KG, Neumuenster (DE)

( * ) Notice: Subject to any disclaimer, the term of this patent is extended or adjusted under 35 U.S.C. 154(b) by 0 days.

(21) Appl. No.: 09/635,973

(22) Filed: Aug. 10, 2000

(30) Foreign Application Priority Data

Aug. 12, 1999 (DE) ..... 199 38 078

(51) Int. Cl.[7] ..... B67D 5/00
(52) U.S. Cl. ..... 222/83; 222/156; 222/459
(58) Field of Search ..... 222/81, 83, 835, 222/88, 156, 158, 189.09, 459

(56) References Cited

U.S. PATENT DOCUMENTS 3,438,549 A * 4/1969 Ritz ..... 222/83.5
3,538,866 A * 11/1970 Gaines ..... 222/83.5
5,364,386 A * 11/1994 Fukuoka et al. ..... 222/83
5,413,253 A * 5/1995 Simmen ..... 222/459
5,503,302 A * 4/1996 DeJonge ..... 222/83
5,509,578 A * 4/1996 Livingstone ..... 222/83
5,575,409 A * 11/1996 Gruendeman ..... 222/459
5,785,858 A * 7/1998 Webb ..... 222/189.09
5,884,816 A * 3/1999 Hinze ..... 222/158
5,893,484 A * 4/1999 Fuchs et al. ..... 222/83
6,237,814 B1 * 4/2001 Blyler et al. ..... 222/189.09

* cited by examiner

*Primary Examiner*—Joseph A. Kaufman
(74) *Attorney, Agent, or Firm*—Cohen, Pontani, Lieberman & Pavane

(57) ABSTRACT

Disclosed is a holder, attachable to a receptacle, with a hollow spike for piercing the membrane of the receptacle and with a connection piece arranged coaxially to the hollow spike for the releasable attachment of an injection syringe. For the quick and secure withdrawal of a liquid medicament from the receptacle whilst maintaining sterility demands the holder is formed as a closed-walled protective housing which accommodates the receptacle and which comprises a first housing part carrying the receptacle secured in position and a second housing part provided in its inside with the hollow spike and on the outside comprising the connection piece. The second housing part is coaxially movable relative to the first housing part between a position-secured initial position in which the hollow spike is distanced from the membrane and a working position in which the membrane is pierced through the hollow spike.

21 Claims, 2 Drawing Sheets

DEVICE FOR WITHDRAWING A READY LIQUID MEDICAMENT FROM A RECEPTACLE PROVIDED WITH A PIERCEABLE MEMBRANE

BACKGROUND OF THE INVENTION

The invention is in a holder to be used with a receptacle with a pierceable membrane and from which a liquid medicament is to be withdrawn.

In practice with a receptacle or bottle containing a liquid medicament or initially containing a medicinal dry substance to which is added a fluid at the place of application and is manufactured into a liquid medicament, and is provided with a pierceable membrane, it is known after removal of a protective cap from the receptacle or bottle to press onto this bottle or receptacle an adapter for holding an injection syringe. This adapter comprises a plate part which on its one side has a central hollow spike and several holding claws on its circumference, and on the other side has a connection piece which is for the injection syringe and which is coaxial to the hollow spike. At the point in time of the medicinal application to the patient the adapter with its holding claws is pressed onto the receptacle and latchingly fastened thereto, wherein the hollow spike pierces through the membrane of the receptacle. Subsequently the medicinal injection syringe with a cannula is stuck onto the connection piece of the adapter. In the case of a ready liquid medicament in the receptacle this medicament by way of the syringe in the desired quantity is drawn into the syringe out of the receptacle through the hollow spike. When the receptacle contains a medicinal dry substance, firstly by way of a syringe without a cannula or by way of another suitable apparatus, a liquid is added into the receptacle in order to dissolve the dry substance for creating a liquid medicament. The liquid medicament prepared in this manner by way of an injection syringe is then removed from the receptacle. This known device has a series of disadvantages.

The handling of the adapter on sticking onto the receptacle in particular in an emergency is very complicated and time-consuming, which also applies to the receptacle itself, wherein there exists the danger that the adapter which as a rule is manufactured of plastic, is for example damaged on its latching claws so that it may not be stuck onto the receptacle in a securely functioning manner. Furthermore there exists the danger that the adapter and receptacle after their removal from their sterile packaging become contaminated so that the treatment of the patient is accordingly burdened with a high risk. Furthermore the receptacle which either contains the liquid medicament already ready to be applied or a dry substance which is first to be dissolved by way of a solvent may easily break, in particular when it rolls away from a preparation underlay and falls down, since as a rule it consists of glass and is handled unprotected. Finally the adapter represents a loose part which in particular in an emergency in which quick handling procedures are necessary may fall down, roll away and/or get lost so that the filling of the injection syringe and/or withdrawal therefrom is at least considerably delayed.

SUMMARY OF THE INVENTION

The object of the invention lies in the improvement of a device of the previously cited type which ensures a quick and simple handling of the receptacle as well as being able to be securely handled itself, prevents a contamination of the receptacle to a significant degree, permits a lasting sterilization of the outer surface of the receptacle and protects the receptacle from loss and damage.

By way of the solution according to the invention, i.e. on account of the positioning of the receptacle in a protective container already after the filling of a liquid medicament or of a dry substance into the receptacle there is already fulfilled a preparing handling for the withdrawal or preparation of a liquid medicament from the receptacle, so that operations according to this. i.e. for example removing the protective lid from the receptacle and placing on an adapter are done away when treating the patient, and by way of this valuable time is gained for treating the patient. The patient may thus be quickly and safely cared for, which in an emergency is very important. The receptacle with the medicament is thus according to the invention already preassembled in the protective container and thus may be commercially marketed and stored.

For withdrawing the fluid medicament from the receptacle, according to the invention only the closure cap of the protective housing for the receptacle is removed and the needle-free injection syringe is inserted into the connection piece of the protective housing. Then the protective housing is pressed together so that the hollow spike pierces through the membrane of the receptacle, whereupon the syringe is filled with the liquid medicament from the receptacle. If the receptacle contains a medical dry substance for the manufacture of the ready liquid medicament, liquid via a filled syringe or likewise is added into the receptacle in order to dissolve the dry substance and to withdraw without a needle the thus prepared liquid medicament from the receptacle by way of an application syringe. Thereafter the application syringe is provided with a common injection cannula, whereupon the patient may be immediately treated.

A further advantage lies in the fact that the sterilization and the maintaining of the sterility of the receptacle in the protective housing according to the invention is improved since the inside of the protective housing may be easily lastingly sterilized and maintained sterile. Furthermore the risk of a subsequent contamination of the whole outer surface of the receptacle for the liquid medicament including the membrane which closes the receptacle and which is to be pierced is ruled out, which also applies to the inner space of the protective housing. Furthermore considerable cost advantages are achieved with the solution according to the invention since the previous protective cap of the receptacle and the packaging material for the receptacle may be done away with since now the protective housing very effectively assumes both functions. Additionally, the protective housing serves as a protection against breakage of the receptacle for the liquid medicament, which as a rule consists of glass.

According to one advantageous embodiment of the invention the second housing part engages over the first housing part in a sealed and frictionally engaged manner, wherein one of the housing parts at its open end comprises a projecting circumferential seal formation which slidingly and sealingly bears on the side of the other housing part. This circumferential seal formation is at the same time formed such that a suitably strong friction fit at the two housing halves is effected in order to ensure position securement of the second housing part in its both end positions on the first housing part.

In a further embodiment of the invention the second housing part comprises two diametrically opposite outwardly projecting grip tabs in order to be able to handle the device securely and quickly and to prevent a rolling away from a preparation underlay.

In a further advantageous embodiment the first housing part of the protective housing inside is dimensioned and configured such that the receptacle with the liquid medicament bears with a friction fit on at least one part of the inner surface of the first housing part so that the receptacle is held secured in position in the first housing part.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF A PREFERRED EMBODIMENT

Figure 1:
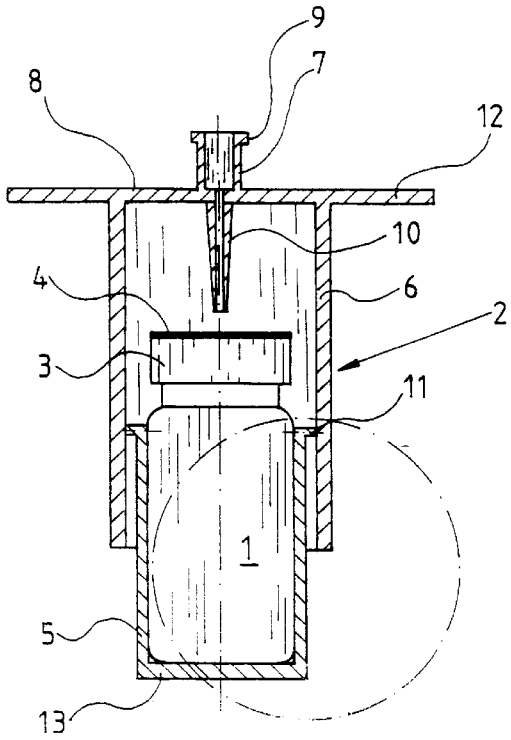
FIG. 1 is an axial section through the embodiment example.

Referring to the drawings, an apparatus for withdrawing a ready fluid medicament from a receptacle 1 comprises a protective housing 2 in which the receptacle is secured in position. The receptacle 1 is as a rule a bottle consisting of transparent glass which contains either a ready liquid medicament or a dry substance, for example in powder form, which by way of adding a fluid is manufactured to a ready liquid medicament. After adding the liquid medicament which is later to be withdrawn or the dry substance which is envisaged therefor, the receptacle in the usual manner is provided with an unreleasable closure 3 which on its upper side contains a pierceable membrane 4. Receptacles of this type for application of medicine are known and are not per se the subject-matter of the invention.

The protective housing 2 consists of a first housing part 5 which accommodates the receptacle 1 in a manner in which this receptacle is secured position. as FIG. 1 shows, and of a second housing part 6 which seals the first housing part 5, coaxially engages over it and is coaxially displaceable relative thereto. The second housing part 6 comprises on its upper end wall 8 a connection piece 7, in which e.g. a medical syringe (not shown) may be temporarily fixed in order to withdraw a desired quantity of the ready liquid medicament from the receptacle 1 or in order first to add a dissolving fluid into the receptacle when it contains the mentioned dry substance. The connection piece 7 which is located on the outer side of the upper end wall 8 of the second housing part 6 has at its free upper end inclined connections 9 in order to be able to fix thereto withdrawal apparatus such as e.g. medical syringes or also tubings. Common connections are for example Luer connections or Luer lock connections which are generally known.

Within the second housing part 6 and extending downwardly from the upper end wall 8 a hollow spike 10 for piercing the membrane 4 of the receptacle when the housing part 6 is pressed down. After piercing the membrane, the hollow spike 10 permits the withdrawal of the liquid medicament from the receptacle 1 or the previous adding of a solvent to dissolve a medicinal dry substance and subsequently the withdrawal of the resulted liquid medicament. The hollow spike 10 is generally arranged coaxial to the connection piece 7 as illustrated FIG. 1.

The two housing parts 5 and 6 which consist preferably of transparent material are advantageously cylindrical and with the exception of the location at which the hollow spike 10 is provided are formed closed-walled so that the protective housing is likewise closed-walled towards the outside. wherein the connection piece 7 is closable with a closure cap which is not shown, in order to ensure sterile conditions in the inside of the protective housing when the receptacle 1 is not in use. The transparency of the housing parts permits the control of the degree of filling, of the condition of the mixing of substances as well as the reading of the label of the receptacle. As is further illustrated in FIG. 1 the second housing part 6 is located in an upper initial position in which the hollow spike 10 is distanced from the membrane 4 of the receptacle 1. If the second housing part 6 is pressed down, whereby the hollow spike 10 pierces the membrane 4, housing part 6 is in a lower working position in which a withdrawal from the receptacle 1 is made possible. Both positions of the second housing part 6 are for example secured in that the second housing part 6 with a suitable friction fit bears on the outside on the first housing part 5.

Figure 2:
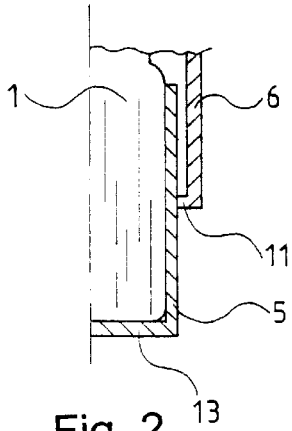
FIG. 2 is a part section according to the circle in FIG. 1.
Figure 3:
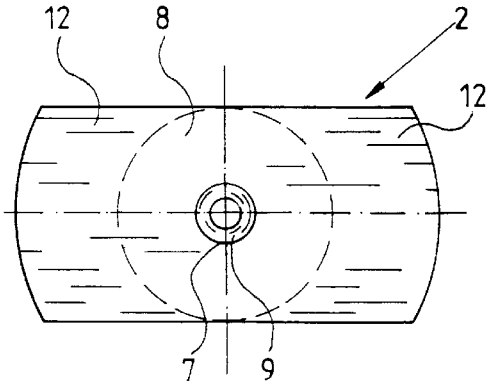
FIG. 3 is a plan view of the embodiment example according to FIG. 1.
Figure 4:
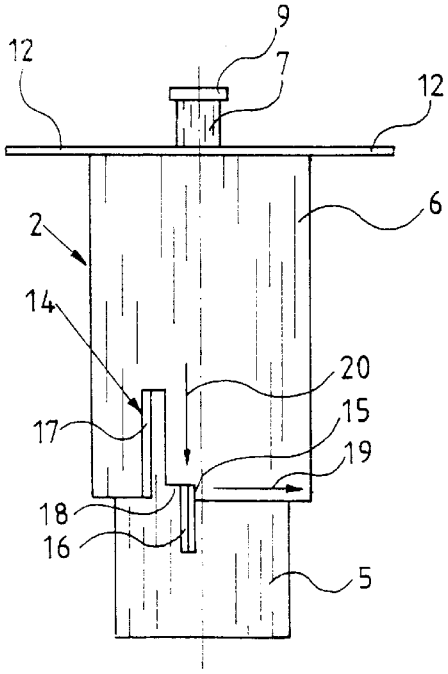
FIG. 4 is a lateral view of the embodiment example according to FIG. 1.

The frictional engagement of the two housing halves 5 and 6 on one another brings about a sealing between these two housing halves. In a preferred embodiment the upper edge of the first housing part 5 is provided with an outwardly projecting circumferential sealing ring 11 which slidingly and sealingly bears on the cylindrical inner side of the second housing part 6. In order to securely ensure the position securement and the initial position and working position of the second housing part 6 on the first housing part 5, the outer dimensioning of the circumferential sealing ring 11 is configured such that there is a suitably strong friction fit on the cylindrical inner wall of the second housing part 6. Alternatively it is possible for the circumferential sealing ring 11 to be provided at the lower and open end of the second housing part 6 and to sealingly bear on the first housing part 5 with friction (FIG. 2).

For a more simple operation of the second housing part 6, part 6 comprises preferably at its upper end two diametrically opposite, outwardly projecting grip tabs 12 which are actuated by hand to displace the second housing part relative to the first housing part, by which means the first housing part 5 and thus the receptacle 1 located therein comes into its withdrawal position. The tabs 12 also prevent the rolling away of the device prepared ready for use.

For securing the position of receptacle 1 in the first housing part 5, this housing part at its cylindrical inner side is configured such that the receptacle on the inner side of the housing part 5 is held rigidly by a friction fit. In this embodiment the housing part 5 with its inner diameter is coordinated with the outer diameter of the receptacle 1 such that the receptacle is fastened in the housing part 5 by an interference or similar type fit. Alternatively also other friction fit means on the inner side of the housing part 5 are possible, for example longitudinally running ribs or other projections (not shown). The first housing part 5 at a lower section thereof has an end wall 13 which serves as an abutment for the receptacle 1 to sit on.

For fixing the withdrawal position of the first housing part 5 in the second housing part 6, the height of the first housing part may be dimensioned such that its upper edge is located above the membrane 4 of the closure 3 of the receptacle 1, i.e. the used receptacle has a smaller height than the first housing part. In such a case the mentioned upper edge serves as an abutment against which the upper end wall 8 of the second housing part 6 comes to bear. Thus the hollow spike 10 is located in its working position when it has pierced the membrane 4 by pressing down the second housing part 6.

In another embodiment, the two housing parts 5, 6 in length are coordinated to one another such that the end wall 13 of the first housing part 5 with its inserted withdrawal position flushly occludes with the open lower end of the second housing part 6. Furthermore, the second housing part 6 with a design according to FIG. 2 with its circumferential sealing ring 11 may engage behind the end wall 13 of the first housing part 5. By way of this a multiple use of the device is avoided or at least made considerably more difficult.

Alternatively the protective housing 2 may be provided with a mechanism indicated generally at 14 which serves for securing the lower end position of the second housing part 6 as well as its upper end position, i.e. its initial position, and for the guided execution of the piercing movement of the hollow spike 10 located on the second housing part. The mechanism 14 comprises on the circumferential wall of the second housing part 6 a relief 18, an abutment shoulder 15, a guide groove 17 circumferentially distanced thereto as well as on the first housing part 5 a guide projection 16. The abutment shoulder 15 lies opposite the lower and open end of the guide groove 17.

If for the withdrawal of a ready liquid medicament from the receptacle 1 by way of a medical injection syringe firstly the hollow spike 10 is to pierce the membrane 4 of the receptacle, then the second housing part 6 is firstly rotated according to the arrow 19 so that the guide projection 16 comes to lie in front of the entrance of the guide groove 17. Then the second housing part 6 is pressed down according to the arrow 20, by which means the guide projection 16 comes into the guide groove 17 and the hollow spike 10 pierces the membrane 4 of the receptacle 1. After attaching a needle-free injection syringe to the connection piece 7 then by way of this syringe the ready liquid medicament may be withdrawn from the receptacle. In the case in which in the receptacle there is located a medicinal dry substance firstly a suitable fluid by way of a needle-free syringe or likewise is added into the receptacle, by which means the dry substance dissolves and the ready liquid medicament is formed. With the injection syringe to be used on the patient the ready liquid medicament is then withdrawn from the receptacle 1. If the injection syringe to be used is filled with the liquid medicament the injection syringe is provided with the usual piercing cannula in order to inject the liquid medicament into the patient.

Figure 5:
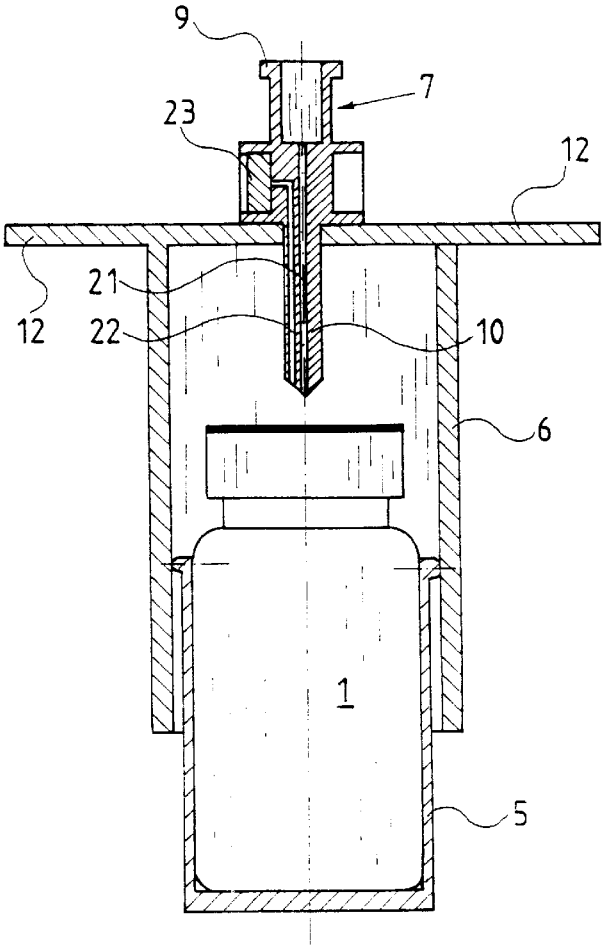
FIG. 5 is an axial section through a modified embodiment example.
Figure 6:
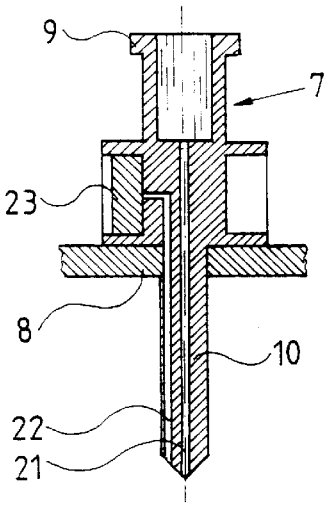
FIG. 6 is a detail of the example according to FIG. 5.

In order to simplify the withdrawal of the liquid medicament from the receptacle 1, the hollow spike 10 according to FIG. 5 may be formed such that it next to its channel 21 for the fluid transport comprises an additional channel 22 with a filter 23 in the connection piece for vacuum compensation in the receptacle. FIG. 6 shows this design of the hollow spike in an enlarged representation in order to be able to better recognize the two channels better.

Figure 7:
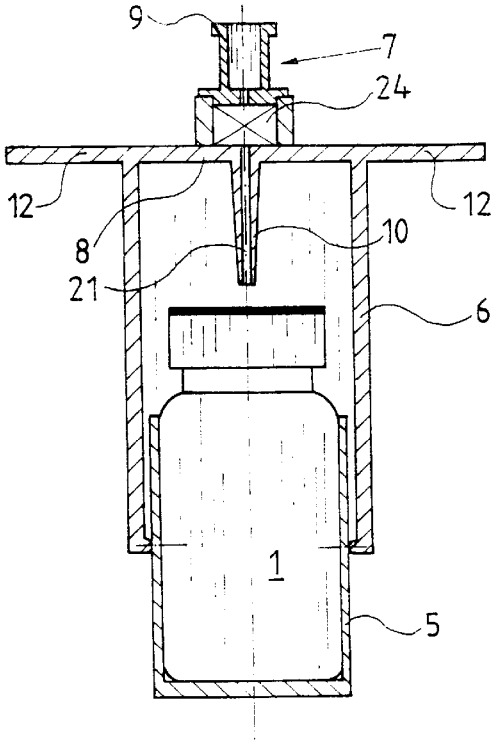
FIG. 7 is an axial section through a further modified embodiment example.

In yet a further embodiment of the apparatus according to the invention. according to FIG. 7 one may proceed in that the connection piece 7 centrically above the hollow spike 10 is provided with a schematically indicated mixer 24. The mixer is advantageous when in the receptacle 1 there is located a dry substance which before use is to be formed into a liquid medicament with a fluid solvent. The solvent may consist of several substances which firstly are mixed in the mixer. whereupon they reach the dry substance in order to dissolve it. Additionally or alternatively the dissolved substance, i.e. the liquid medicament, for the purpose of achieving a good homogeneity in the mixer may be mixed once again if the drawing up of the dissolved substance from the receptacle 1 into a syringe or cannula is carried out.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

What is claimed is:

1. An apparatus for withdrawing a liquid medicament from a receptacle which is provided with a piercable membrane comprising: a holder attachable to the receptacle, wherein the holder is formed as a closed-walled, outwardly sealing protective housing accommodating the receptacle and comprises a first housing part carrying the receptacle in a position-secured manner, and a second housing part having a hollow spike for piercing the membrane of the receptacle, said second housing part being movable relative to the first housing part between a position-secured initial position in which the hollow spike is spaced from the membrane and a working position in which the membrane is pierced by the hollow spike, said second housing part having a connection piece arranged coaxially to the hollow spike to accommodate an injection syringe for filling this syringe, the connection piece being closeable and accessible from the outside.

2. The apparatus of claim 1, wherein the second housing part seals the first housing part and engages over it with a friction fit.

3. The apparatus of claim 1, wherein the second housing part has an innerside and the first housing part has an open upper end which comprises an outwardly projecting circumferential sealing ring wherein said sealing ring slidingly and sealingly bears on the inner side of the second housing part.

4. The apparatus of claim 3, wherein the second housing part with the withdrawal position of the first housing part, engages with its circumferential sealing ring behind the end wall of the first housing part.

5. The apparatus of claim 3, wherein the circumferential sealing ring of the first housing part has a sufficient friction fit to secure a position of the first housing part on the second housing part.

6. The apparatus of claim 1, wherein the first housing part has an outer side and the second housing part has a open lower end which comprises an inwardly projecting circumferential sealing ring which slidingly and sealingly bears on the outer side of the first housing part.

7. The apparatus of claim 6, wherein the circumferential sealing ring of the second housing part has a sufficient friction fit to secure a position of the second housing part on the first housing part.

8. The apparatus of claim 1, wherein the second housing part comprises two diametrically opposite, outwardly projecting grip tabs.

9. The apparatus of claim 1, wherein the second housing part has an upper end wall with an outer side provided with the connection piece.

10. The apparatus of claim 9, wherein the connection piece is provided with fastening means for the releasable attachment of the injection syringe or a connection tubing.

11. The apparatus of claim 1, wherein the first and second housing parts are cylinder-shaped with, in each case, one end wall and coaxially engage on another.

12. The apparatus of claim 1, wherein the protective housing further comprises a mechanism for securing the initial position of the second housing part and for the guided execution of the piercing movement of the inner hollow spike.

13. The apparatus of claim 12, wherein the mechanism is formed by an abutment shoulder on the second housing part and, circumferentially cooperating with this, a guide projection on the outer side of the circumferential wall of the first housing part, and by a guide groove for the guide projection on the second housing part.

14. The apparatus of claim 13, wherein the abutment shoulder and the guide projection are arranged essentially at the same height and that the abutment shoulder is formed by a relief at the open end of the guide groove.

15. The apparatus of claim 1, wherein the hollow spike next to its channel for the fluid transport comprises an additional channel which cooperates with a filter in the connection piece for the vacuum compensation in the receptacle.

16. The apparatus of claim 1, wherein the first housing part accommodating the receptacle for the liquid medicament, on its inner side, comprises a formation which holds the receptacle in its position with a friction fit.

17. The apparatus of claim 1, wherein the first and second housing parts are of transparent material.

18. The apparatus of claim 1, wherein the connection piece via the hollow spike has a mixer.

19. The apparatus of claim 1, wherein each of the first and second housing parts is coordinated to one another such that the lower end of the second housing part, with the first housing part inserted therein in the withdrawal position, occludes flush with the lower end of the first housing part.

20. A protective apparatus for withdrawing a liquid medicament from a receptacle which is provided with a pierceable membrane comprising: a holder attachable to the receptacle, wherein the holder is formed as a closed-walled, outwardly sealing protective housing accommodating the receptacle and comprises a first housing part supporting the receptacle in a position-secure manner, and a second housing housing part having a hollow spike for piercing the membrane of the receptacle, said second housing part being movable relative to the first housing part between a position-secured initial position in which the hollow spike is spaced from the membrane and a working position in which the membrane is pierced by the hollow spike, said second housing part having an upper end wall with an outer side having a connection piece, said connection piece being arranged coaxially to the hollow spike to accommodate an injection syringe for filling the syringe, the connection piece being closeable and accessible from the outside and having a fastening means.

21. The protective apparatus of claim 20, wherein the fastening means is for the releasable attachment of the injection syringe or a connection tubing.

* * * * *